US011623134B1

(12) United States Patent
Plumer et al.

(10) Patent No.: US 11,623,134 B1
(45) Date of Patent: Apr. 11, 2023

(54) SYSTEM AND METHOD FOR FOOSBALL TABLE IMPLEMENTING PLAYING OBSTACLES

(71) Applicant: TOCA Football, Inc., Costa Mesa, CA (US)

(72) Inventors: Stephen Plumer, London (GB); Nicholas Runeckles, Whitstable (GB); Wayne Rapp, Irvine, CA (US)

(73) Assignee: TOCA Football, Inc., Costa Mesa, CA (US)

( * ) Notice: Subject to any disclaimer, the term of this patent is extended or adjusted under 35 U.S.C. 154(b) by 69 days.

(21) Appl. No.: 17/192,766

(22) Filed: Mar. 4, 2021

(51) Int. Cl.
*A63F 7/38* (2006.01)
*A63F 7/06* (2006.01)
(Continued)

(52) U.S. Cl.
CPC ..... *A63F 7/38* (2013.01); *A63F 7/0017* (2013.01); *A63F 7/0616* (2013.01);
(Continued)

(58) Field of Classification Search
CPC ..... A63F 7/38; A63F 7/0017; A63F 7/0616; A63F 7/0672; A63F 7/3055; A63F 7/307;
(Continued)

(56) References Cited

U.S. PATENT DOCUMENTS 3,771,789 A * 11/1973 Kammerl ..... A63F 7/40 273/119 B
5,833,235 A 11/1998 Lesley et al.
6,234,476 B1 5/2001 Yamashita et al.
2002/0070688 A1* 6/2002 Dowling ..... F21S 4/28 315/312
2006/0229146 A1* 10/2006 Giegerich ..... A63B 67/04 473/431
(Continued)

FOREIGN PATENT DOCUMENTS

EP 0271421 B1 3/1991
FR 3043335 A1 5/2017
WO 2008/071799 A1 6/2008

OTHER PUBLICATIONS

Rogers et al."KickAR Exploring Game Balancing Through Boosts and Handicaps in Augmented Reality Table Football." Apr. 2018. Paper No. 166 pp. 1-12 (Year: 2018).*
(Continued)

*Primary Examiner* — Michael D Dennis
(74) *Attorney, Agent, or Firm* — Rutan & Tucker, LLP; Kyle M. St. James

(57) ABSTRACT

A foosball table system is disclosed that includes a playing surface, a plurality of walls extending upward relative to the playing surface, wherein a plurality of rods extend through a first sidewall of the playing surface through a second sidewall of the playing surface, a first goal on a first end wall of the playing surface, a second goal on a second end wall of the playing surface, the second end wall opposite the first end wall, a first and second set of user input controls, a processor and a non-transitory, computer-readable medium communicatively coupled to the processor and having logic stored thereon that, when executed by the processor, causes performance of operations including receive user input from either of the first set of user input controls or the second set of user input controls, and modifying gameplay of a foosball game currently being played using the foosball table system.

22 Claims, 9 Drawing Sheets

(51) Int. Cl.

| | |
|---|---|
| ***A63F 7/00*** | (2006.01) |
| ***A63F 7/30*** | (2006.01) |
| ***A63F 9/24*** | (2006.01) |
| ***A63F 7/34*** | (2006.01) |
| ***A63F 7/36*** | (2006.01) |

(52) U.S. Cl.
CPC ..... *A63F 7/0672* (2013.01); *A63F 7/307* (2013.01); *A63F 7/3055* (2013.01); *A63F 9/24* (2013.01); *A63F 2007/303* (2013.01); *A63F 2007/3005* (2013.01); *A63F 2007/341* (2013.01); *A63F 2007/3685* (2013.01); *A63F 2300/00* (2013.01)

(58) Field of Classification Search
CPC ..... A63F 9/24; A63F 2007/3005; A63F 2007/303; A63F 2007/341; A63F 2007/3685; A63F 2300/00
See application file for complete search history.

(56) References Cited

U.S. PATENT DOCUMENTS

| | | | | |
|---|---|---|---|---|
| 2010/0194038 | A1* | 8/2010 | Simon | A63F 7/0672 273/108.52 |
| 2011/0233860 | A1* | 9/2011 | Crawford | A63F 7/3603 273/108.57 |
| 2013/0056928 | A1* | 3/2013 | Toma | A63F 7/066 273/129 AP |
| 2020/0016479 | A1* | 1/2020 | Grant | A63F 7/06 |

OTHER PUBLICATIONS

PCT/US2022/018555 filed Mar. 2, 2022, International Search Report and Written Opinion dated May 12, 2022.
Rogers et al. "Kick AR Exploring Game Balancing Through Boosts and Handicaps in Augmented Reality Table Football." CHI' 18: Proceedings of the 2018 CHI Conference on Human Factors in Computing Systems. Apr. 2018. Paper No. 166 pp. 1-12.

* cited by examiner

SYSTEM AND METHOD FOR FOOSBALL TABLE IMPLEMENTING PLAYING OBSTACLES

FIELD

Embodiments of the disclosure relate to the field of foosball tables. More specifically, one embodiment of the disclosure relates to foosball table systems or apparatuses that include one or more playing obstacles configured to alter the playing experience during a foosball match. In some embodiments of the disclosure, the one or more playing obstacles are implemented through computerized methods.

GENERAL BACKGROUND

The exact origin of the game of foosball, also referred to as table soccer, is unknown with claims of inception stemming back to the 1880s. Since then, the concept of the foosball table and gameplay of a foosball match has gone relatively unchanged. Even as the game spread across the world, the original design of the foosball maintained its original design. During the 1960s and 1970s, the game of foosball grew in popularity in the United States and reached its peak of popularity in the 1970s and 1980s, coinciding with the rise in popularity of arcades and coin operated machines. However, in 2002, the International Table Soccer Federation (ITSF) was established to restore the popularity of foosball and also provide a governing body for specifying rules and organizing competitions, etc.

Even in light of these swings in popularity, and relatively recent establishment of an international governing body for the sport, the original concept for the foosball table and foosball gameplay remains unchanged. As electronic devices have risen considering in popularity, with many versions of hand-held electronic devices now ubiquitous in society, changes are needed to the original concept of a foosball table and foosball gameplay in order to attract players and retain their interest. Especially in social settings, such as recreation rooms, bowling alleys, arcades, etc., alterations that attract attention and excitement to a foosball table are needed.

The systems and methods disclosed herein provide unique and novel solutions to address shortcomings of conventional foosball tables with respect to the above. The concepts provided herein will become more apparent to those of skill in the art in view of the accompanying drawings and following description, which disclose particular embodiments of such concepts in greater detail.

BRIEF DESCRIPTION OF THE DRAWINGS

Embodiments of the disclosure are illustrated by way of example and not by way of limitation in the figures of the accompanying drawings, in which like references indicate similar elements and in which.

DETAILED DESCRIPTION

Figure 1:
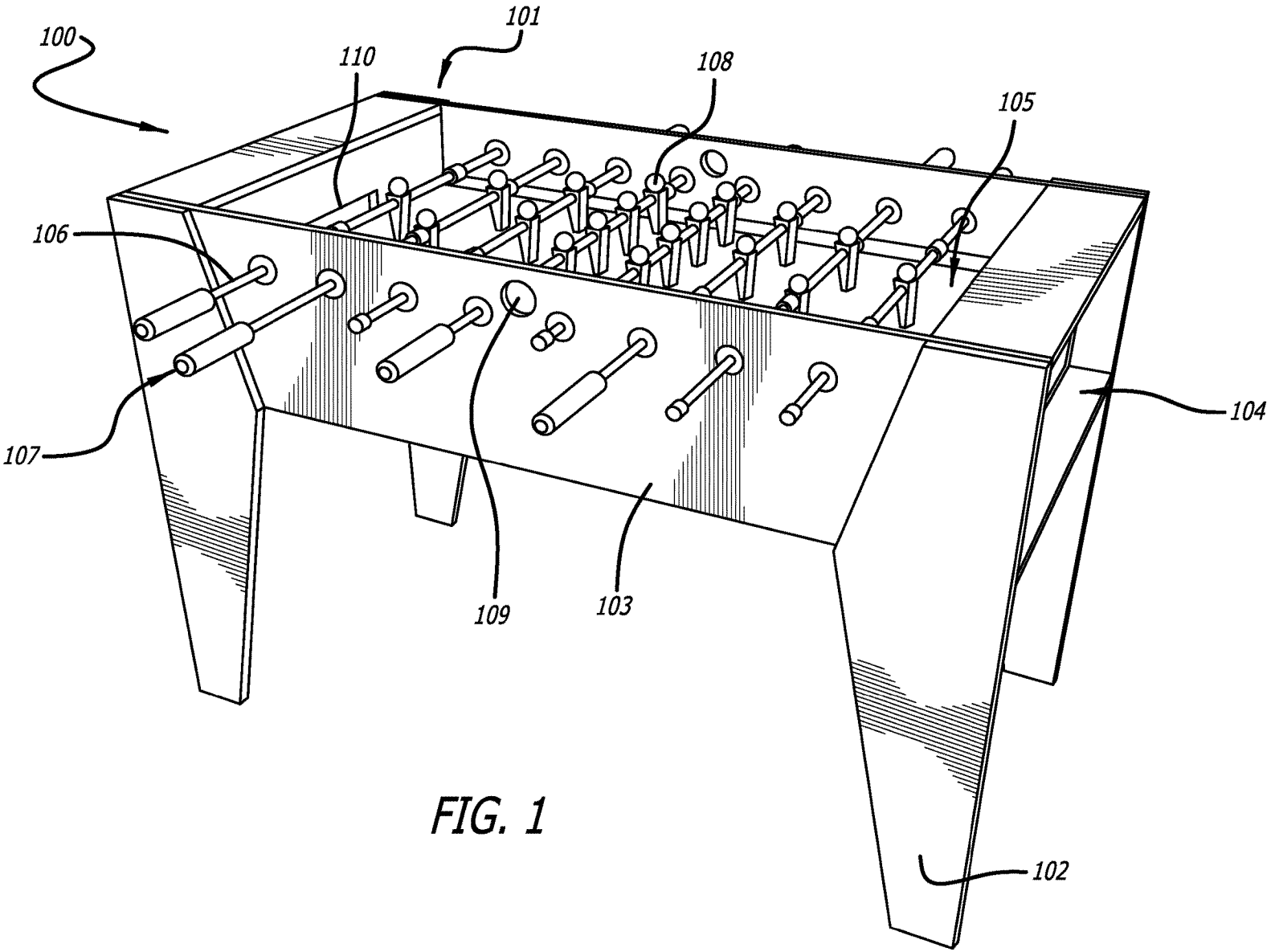
FIG. 1 illustrates a conventional foosball table in accordance with some embodiments.

Various embodiments of the disclosure relate to foosball table systems that include one or more obstacles or alterations to the playing environment. In some particular embodiments, a foosball table system includes activation buttons accessible to each player or team, which cause activation of one or more of the obstacles or alterations, which may include, air vents that produce an airstream directed at altering the advancement of a foosball (e.g., alter the advancement along the playing surface or alter the advancement into a goal). The air vents act as an obstacle to a player attempting to strategically advance a foosball toward an opponent's goal and/or advance the foosball into the opponent's goal.

The obstacles or alterations may also include release of a "money" ball, which may count for additional goals for the scoring team or just the activating team, depending on the configuration and embodiment. An alteration to the playing environment may be the release of a money ball such that there are multiple foosballs in play. In some embodiments, the money ball may vary in color from the standard foosball. In other embodiments, the money ball may be illuminated by lights integrated therein. In some specific embodiments, the illuminated color of the lights may indicate which team receives the additional goals (while the other team receives a standard, single goal, or no goals at all, for scoring the money ball). Various embodiments are discussed below.

Additionally, the obstacles or alterations may also include physical barriers that "pop-up" from the playing surface, swing open from the sideline walls and/or close across the goal mouth. Further, the obstacles or alterations may also include an adjustment of the leg height of or more of the legs of the foosball table system. Such adjustment(s) result in a tilt of the playing surface.

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

In certain situations, the terms "logic" and "subsystem" are representative of hardware, firmware, and/or software that is configured to perform one or more functions. As hardware, the logic (or subsystem) may include circuitry having data processing and/or storage functionality. Examples of such circuitry may include, but are not limited or restricted to a processor, a programmable gate array, a microcontroller, an application specific integrated circuit, wireless receiver, transmitter and/or transceiver circuitry, semiconductor memory, or combinatorial logic.

Alternatively, or in combination with hardware circuitry, the logic (or subsystem) may be software in the form of one or more software modules. The software modules may include an executable application, a daemon application, an application programming interface (API), a subroutine, a function, a procedure, an applet, a servlet, a routine, source code, a shared library/dynamic load library, or even one or more instructions. The software module(s) may be stored in any type of a suitable non-transitory storage medium, or transitory storage medium (e.g., electrical, optical, acoustical or other form of propagated signals such as carrier waves, infrared signals, or digital signals). Examples of non-transitory storage medium may include, but are not limited or restricted to a programmable circuit; a semiconductor memory; non-persistent storage such as volatile memory (e.g., any type of random access memory "RAM"); persistent storage such as non-volatile memory (e.g., read-only memory "ROM", power-backed RAM, flash memory, phase-change memory, etc.), a solid-state drive, hard disk drive, an optical disc drive, or a portable memory device. As firmware, the logic (or subsystem) may be stored in persistent storage.

The term "network device" should be generally construed as physical logic (electronics) or virtualized logic with data processing capability and/or a capability of connecting to any type of network, such as a public network (e.g., internet), a private network (e.g., any type of local area network), a public cloud network (e.g., Amazon Web Service (AWS®), Microsoft Azure®, Google Cloud®, etc.), or a private cloud network. Examples of a network device may include, but are not limited or restricted to, any of the following: a server; a mainframe; a firewall; a data transfer device (e.g., intermediary communication device, router, repeater, portable mobile hotspot, etc.); an endpoint device (e.g., a laptop, a smartphone, a tablet, a desktop computer, a netbook, gaming console, etc.); or a virtual device being software that supports data capture, preliminary analysis of meta-information associated with cybersecurity intelligence.

The term "message" generally refers to signaling (wired or wireless) as either information placed in a prescribed format and transmitted in accordance with a suitable delivery protocol or information made accessible through a logical data structure such as an API. Examples of the delivery protocol include, but are not limited or restricted to HTTP (Hypertext Transfer Protocol); HTTPS (HTTP Secure); Simple Mail Transfer Protocol (SMTP); File Transfer Protocol (FTP); iMESSAGE®; Instant Message Access Protocol (IMAP); or the like. Hence, each message may be in the form of one or more packets, frames, or any other series of bits having the prescribed, structured format.

The term "computerized" generally represents that any corresponding operations are conducted by hardware in combination with software and/or firmware.

The term "transmission medium" generally refers to a physical or logical communication link (or path) between two or more network devices. For instance, as a physical communication path, wired and/or wireless interconnects in the form of electrical wiring, optical fiber, cable, bus trace, or a wireless channel using infrared, radio frequency (RF), may be used.

In certain instances, the terms "compare," comparing," "comparison," or other tenses thereof generally mean determining if a match (e.g., identical or a prescribed level of correlation) is achieved between two items where one of the items may include content within meta-information associated with the feature.

Finally, the terms "or" and "and/or" as used herein are to be interpreted as inclusive or meaning any one or any combination. As an example, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure is to be considered as an example of the principles of the invention and not intended to limit the invention to the specific embodiments shown and described.

Referring to FIG. 1, a conventional foosball table is shown in accordance with some embodiments. The conventional foosball table 100 illustrated in FIG. 1 includes a table frame 101, a plurality of legs 102, two sidewalls 103, two end walls 104 (each including a goal 110), a playing surface 105 (or "playing field"), a plurality of rods 106 and two ball drops 109. Each of the plurality of rods 106 extend across the frame 102 and through each sidewall 103. Further, each of the plurality of rods 106 includes a handle 107 on one side of the rod 106 and one or more player components 108 (e.g., player figurines). It is noted that only a single goal 110 is visible from the illustrated perspective in FIG. 1.

As is understood about a conventional foosball table such as the foosball table 100, a ball (not shown) may be placed or dropped onto the playing surface 105 with players standing on either side of the table 100 and manipulating the rods 106 via the handles 107 in order to displace the ball in a particular direction, e.g., toward the opposing player's or players' goal 110. The ball is displaced through direct contact with a player component 108 and typically travels along the playing surface 105. A player may manipulate a rod 106 by pulling/pushing the road 106 or twisting the rod 107. As is understood, a first subset of rods 106 (i.e., half) are configured to be manipulated by a player or players on one side, while a second subset of rods 106 (i.e., the other half) are configured to be manipulated by a player or players on the opposite side.

Figure 2A:
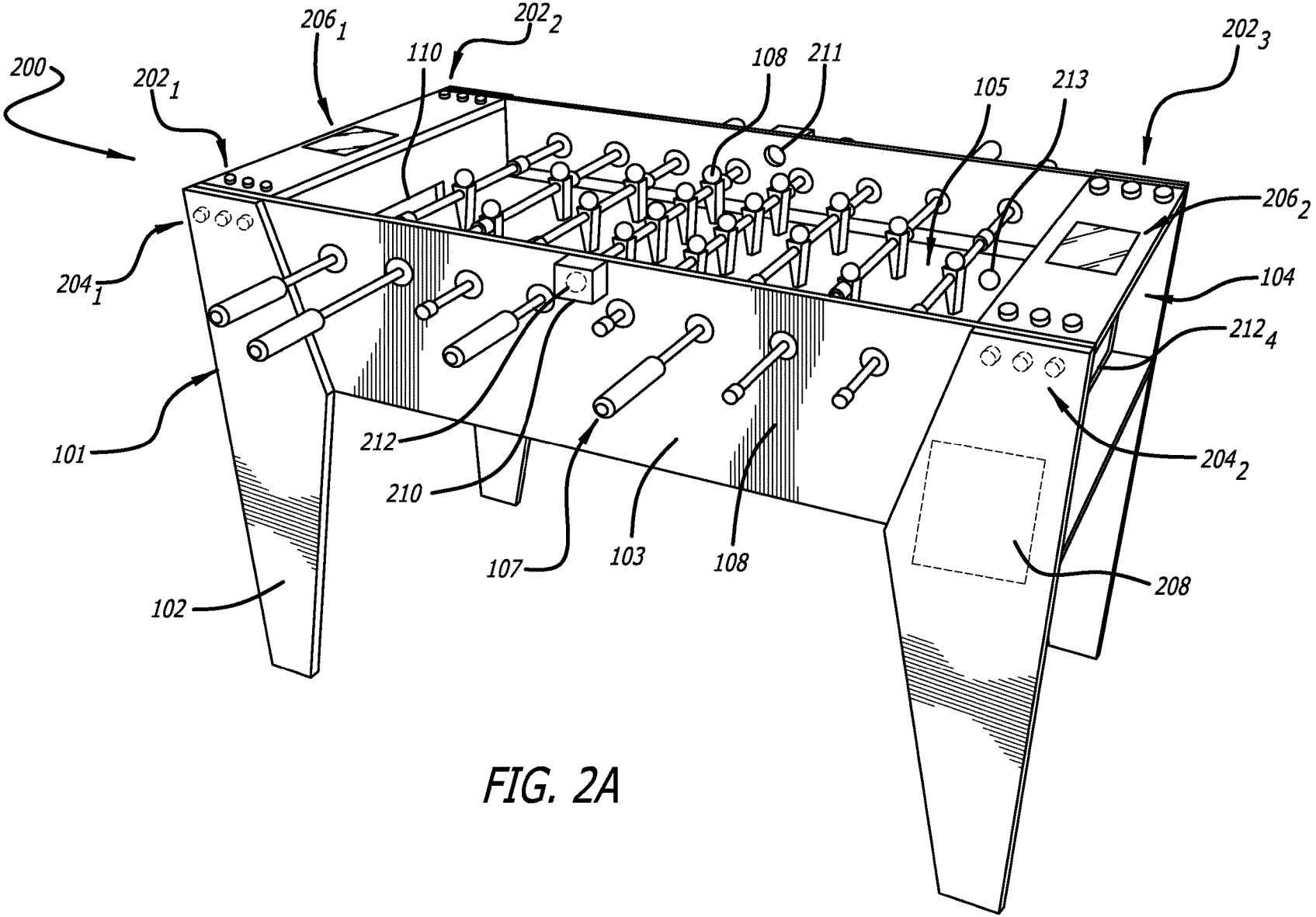
FIG. 2A illustrates a foosball table system configured to implement one or more playing obstacles in accordance with some embodiments.

Referring to FIG. 2A, a foosball table system configured to implement one or more playing obstacles is shown in accordance with some embodiments. The foosball table system 200 includes many of the same components as the table 100 including the frame 101, the plurality of legs 102, sidewalls 103, end walls 104, the playing surface 105, the rods 106, the handles 107 and the player components 108 as well as the goals 110. As will be discussed below, in some embodiments, these components may be modified in such a way so to provide novel concepts directed to improving a player's experience while utilizing the foosball table system 200. Further, a foosball 213 is illustrated.

As further shown in FIG. 2A, the foosball table system 200 includes a plurality of activation buttons, where a set of activation buttons $\mathbf{202}_1$-$\mathbf{202}_4$ may be located at each corner of the frame 102. Additionally, the foosball table system 200 may optionally include a plurality of secondary activation buttons, where a set of secondary activation buttons $\mathbf{204}_1$-$\mathbf{204}_4$ may also be located at each corner of the frame 102. In one embodiment, as shown, each set of activation buttons $\mathbf{202}_1$-$\mathbf{202}_4$ may be located on a topside of the frame 102 and each set of secondary activation buttons $\mathbf{204}_1$-$\mathbf{204}_4$ may be located on a side of the frame 102. However, placement of either of the activation buttons $\mathbf{202}_1$-$\mathbf{202}_4$ or the secondary activation buttons $\mathbf{204}_1$-$\mathbf{204}_4$ may vary from the illustration of FIG. 2 and be within the scope of the disclosure as such variations have been contemplated (e.g., both on the topside, both on a side, one or more on a side of the end wall 104, or any similar combination, etc.).

The activation buttons $\mathbf{202}_1$-$\mathbf{202}_4$ or the secondary activation buttons $\mathbf{204}_1$-$\mathbf{204}_4$ (collectively referred to as the activation buttons 202-204) may be programmed to receive user input that acts as a triggering event that initiates an alteration to the foosball table system 200, the corresponding gameplay or both. In some embodiments discussed below, such alterations or modifications may be referred to as "obstacles" or "barriers," where the utilization of such terminology will become more apparent to those of skill in the art in view of the accompanying drawings and following description.

In some embodiments, the foosball table system 200 includes one or more display screens $\mathbf{206}_1$-$\mathbf{206}_i$ ($i \geq 1$, wherein $i=2$ for the embodiment of FIG. 2A). The display screens $\mathbf{206}_1$-$\mathbf{206}_2$ (collectively referred to as the display screens 206) may display various information pertaining to the foosball game such as a score, a time element (time remaining or time counter), a team/player name, alerts or indications of events occurring within the foosball game (e.g., a goal scored, a time out, expiration of time, etc.). Further, the display screens 206 may include information regarding the alterations, obstacles or barriers, such as which are available to a player or team, how many instances of each are available to a player or team, a time duration for the alteration, obstacle or barrier, etc.

FIG. 2A further illustrates that the foosball table system 200 includes computing components 208, which may include circuitry and logic such as one or more hardware processors and non-transitory, computer-readable medium having logic stored thereon that is executable by the one or more hardware processors. In some embodiments, the logic is stored in the form of executable instructions. The logic, which may be in the form of logic modules, may perform certain operations or cause performance of certain operations or actions when executed by the one or more processors. For instance, the logic may receive a signal or alert that a triggering event has occurred and, in response, initiate implementation or activation of an alteration, obstacle or barrier. Further, the logic may deactivation of the alteration, obstacle or barrier. Activation and deactivation of each alteration, obstacle or barrier will be discussed in turn with the corresponding embodiment below. The logic will be discussed in-depth throughout the disclosure and is illustrated as part of the logical representation of FIG. 7.

Additionally, FIG. 2A illustrates that the foosball table system 200 may include one or more ball drop mechanisms 210. In some embodiments, a ball drop mechanism 210 may be communicatively (e.g., electrically) coupled to the computing components 208 such that execution of the logic may initiate a ball drop. A ball drop mechanisms 210 may include outer walls and an internal cavity configured to store one or more balls 212 and access an aperture in the sidewall 103 (or optionally an end wall 104) that enables a ball 212 to be dropped onto the playing surface 105. For example, the ball drop mechanism 210 may include a door 211 that may open (slide or swing), which releases the ball 212 on the playing surface 105, where the activation of the door (opening/closing) may be controlled by the computing components 208. In some embodiments, one or more of the balls 212 may be referred to as a "money ball" such that the money ball 212 counts for additional goals (e.g., scoring of the money ball 212 counts for two, three, etc., goals scored).

Figure 2B:
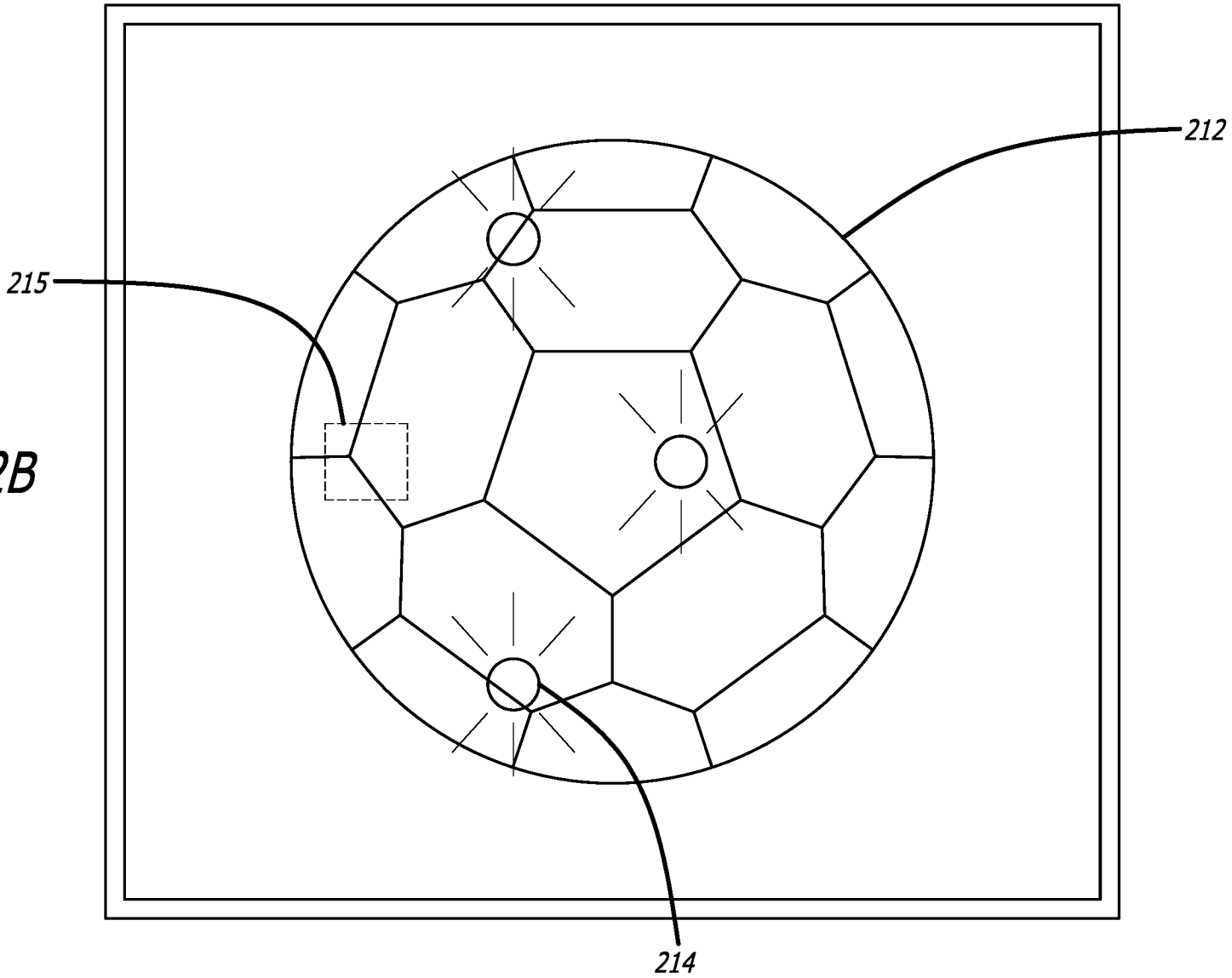
FIG. 2B illustrates an embodiment of an illuminated money ball in accordance with some embodiments.

Referring now to FIG. 2B, an embodiment of an illuminated money ball is shown in accordance with some embodiments. The money ball 212 may be distinguishable from a standard ball via varying colors for example, or it may vary in size (smaller or larger). In some embodiments, as illustrated in FIG. 2B, the money ball 212 may be illuminated via one or more lights 214 integrated into the money ball 212. In some embodiments, the lights 214 are illuminated for the entire time period during which the ball 212 remains on the playing surface. In other embodiments, the lights 214 may be deactivated (turn off) after a predetermined time, where the ball 212 counts as for additional goals only when the lights 214 are activated (turned on). In such embodiments, the computing components 208 may begin a countdown timer at the time the release of the ball 212 was initiated by the computing components 208 such that when a goal is detected prior to expiration of the countdown timer, the scoring player/team may receive the additional goal count.

In yet other embodiments, the lights 214 may vary in color. In some examples, variation in color may pertain to the additional goal count being available only to a particular team (e.g., each team is associated with a color such that when the lights 214 are illuminated in a first team's color, the first team is awarded the additional goal count when the money ball 212 is scored in the second (opposing) team's goal 100 and the second (opposing) team receives no additional goal count if the money ball 212 is scored in the first team's goal). In some embodiments, the color of the illumination of the lights 214 may according to predefined time intervals (e.g., first color for a first 10 seconds, second color for a second 10 seconds, no illumination following 20 seconds). The programming of the lights 214 may be performed by the computing components 208 prior to release of the money ball 214, for example, by transmitting instructions to circuitry 215 within the money ball 212 indicating an illumination sequence (e.g., color(s), time interval(s), etc.). The transmission may occur wirelessly in some embodiments. In other embodiments, the circuitry 215 may be pre-programmed with one or more illumination sequences such that each time the money ball 212 is released, an illumination sequence is implemented based on a predefined order (e.g., where such pre-programming is not performed during gameplay). In some instances, a particular color may represent a negative goal count (or represent a goal count for the non-scoring team).

The computing components 208 would have knowledge of the illumination sequence being implemented (e.g., store the predefined order and corresponding instructions in a database/memory or have access to such) such that the computing components 208 is configured to determine whether the money ball 212 was illuminated (and optionally, with which color) at the time the goal was scored, and the scoring information associated with the illumination (e.g., the numbers of goals a particular team is awarded). The computing components 208 may then adjust a digital scoreboard (e.g., illustrated via an image/portion of the display screens 206). The determination of the time at which a goal was scored will be discussed below with respect to the sensors 304 of FIG. 3A.

Thus, during gameplay, a conventional ball (e.g., including no lights 214 and/or circuitry) may be utilized in the traditional, known manner and, as an alteration or obstacle, a money ball 212 may be released onto the playing surface. In such instances, a plurality of balls may be in play.

It is noted that in embodiments in which the money 212 varies in color from a standard foosball 213, the computing components 208 may obtain knowledge of the color of the goal-scoring ball via a camera included within each goal 110, where the computing components 208 perform an image analysis to determine the color of the goal-scoring ball. In other embodiments, each ball 212-213 may include a radio-frequency identification (RFID) chip and a RFID reader may be included within each goal 110 that obtains a RFID reading and transmits such to the computing components 208. As a result of any of the edits discussed above, the computing components 208 obtain knowledge of which ball 212-213 was scored and can, thus, determine the correct number of goals to assign to the scoring team.

Figure 3A:
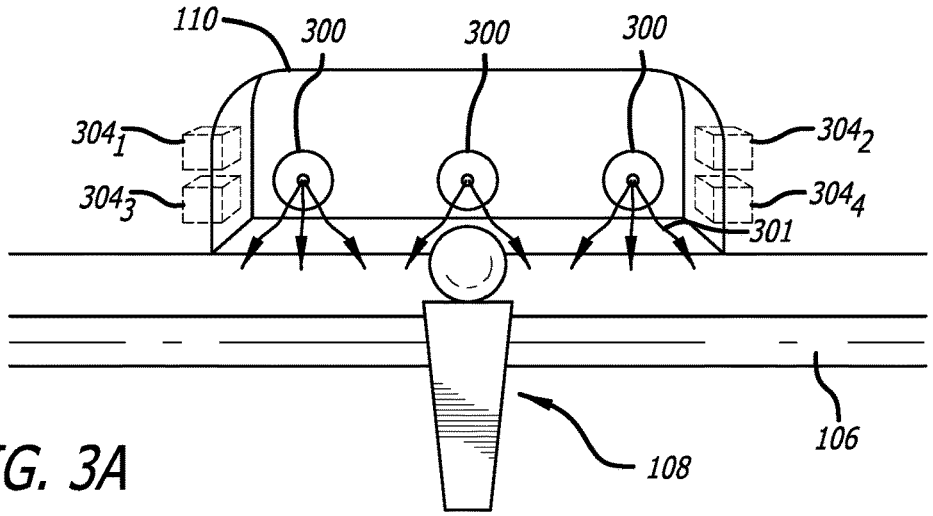
FIG. 3A illustrates an elevation view of a portion of the foosball table system of FIG. 2 implementing a plurality of goal air vents in accordance with some embodiments.

Referring now to FIG. 3A, an elevation view of a portion of the foosball table system of FIG. 2 implementing a plurality of goal air vents is shown in accordance with some embodiments. FIG. 3A provides an illustration of the opening of a goal 110, where the opening may be referred to as the goal mouth and the plane established across the goal mouth may be referred to as a goal plane. The frame 102 includes a plurality of sensors $\mathbf{304}_1$-$\mathbf{304}_4$, where the sensors $\mathbf{304}_1$-$\mathbf{304}_2$ and the sensors $\mathbf{304}_3$-$\mathbf{304}_4$ each form a sensor pair. In some embodiments, the sensors $\mathbf{304}_1$ and $\mathbf{304}_3$ may transmit a through-beam (e.g., an infrared beam) to the sensors $\mathbf{304}_2$ and $\mathbf{304}_4$, respectively. In one embodiment, the sensors $\mathbf{304}_2$ and $\mathbf{304}_4$ may each comprise a reflector that reflects the through-beam back to the corresponding sensor $\mathbf{304}_2$ or $\mathbf{304}_4$. A goal is sensed when a ball interrupts the through-beam (e.g., breaks the goal plane). Thus, the sensors $\mathbf{304}_1$-$\mathbf{304}_4$ are configured to detect when a ball crosses the goal plane (i.e., detect a scored goal). Upon detection of a goal, one or more of the sensors $\mathbf{304}_1$-$\mathbf{304}_4$ transmits a signal to the computing components 208 indicating the goal. In some embodiments, the signal may also include a timestamp, which indicates the time the goal was scored. In other embodiments, the computing components 208 may attach a timestamp to the received signal thereby indicating a time corresponding to the scored goal. In some embodiments, the delay time between detection of the goal and the receipt of the signal by the computing components 208 may be so miniscule that no adjustment of the timestamp is necessary. In other embodiments, a predetermined adjustment of the timestamp during processing by the logic of the computing components 208 may automatically account for such a delay.

In some embodiments, one of the sensor pairs, e.g., $\mathbf{304}_1$-$\mathbf{304}_2$, may represent a camera and/or a RFID reader, which were referenced above in possible embodiments with respect to FIGS. 2A-2B.

In other embodiments, the sensors may merely comprise the sensors $\mathbf{304}_1$ and $\mathbf{304}_3$, where each of the sensors $\mathbf{304}_1$ and $\mathbf{304}_3$ are reflective-type sensors that emit a light beam (visible or infrared) and are configured to detect a light beam reflected from the opposite side of the goalmouth. Thus, such sensors may detect a goal when either or both of the sensors $\mathbf{304}_1$ and $\mathbf{304}_3$ do not detect a reflected light beam (e.g., a foosball passing through the goal mouth causing a break in the light beam). Some examples of reflective-type sensors include, but are not limited or restricted to a light detection and ranging (LIDAR) sensor, a radio detection and ranging (RADAR) sensor, sound navigation and ranging (SONAR) sensor, or a photo-reflective (e.g., photo-electric) sensor. In yet other embodiments, the sensors may merely comprise the sensors $\mathbf{304}_1$ and $\mathbf{304}_3$, where each of the sensors $\mathbf{304}_1$ and $\mathbf{304}_3$ are diffuse-reflective sensors that emit a light beam (visible or infrared) and are configured to detect a light beam reflected from an item passing through the path of the light beam (e.g., a foosball) such that detection of a reflected light beam indicates that a goal has been scored.

Additionally, FIG. 3A illustrates the goal air vents 300 (e.g., an alteration or obstacle) that are configured to provide an airstream 301 (e.g., a constant air flow over a prolonged time period or an airburst), which exits out of the goal mouth toward the playing surface 105. Thus, the goal air vents 300 provide an obstacle to score in the corresponding goal 110 as the airstream 301 restricts or hinders a ball from passing through the goal plane and entering the goal 110. In some situations, depending on the strength of the airstream 301 and the force of a ball, the airstream 301 may preclude the ball from entering the goal 110 altogether (e.g., alter the path of the ball so as to avoid entry into the goal 110). However, in other embodiments, the force of the ball may overpower the airstream 301 such that the ball still enters the goal 110 during activation of the goal air vents 300. The goal air vents 300 may be activated/deactivated (turned on/off) by the computing components 208.

For example, the computing components 208 may receive a signal indicating user input to a particular activation button 202-204, determine that the activated activation button 202-204 corresponds the goal air vents 300 of a particular goal 110 and transmit a signal activating the corresponding goal air vents 300. For example, a first player may be playing against a second player, and the first player may seek to activate air vents within the first player's goal in order to hinder the ability of the second player to score (e.g., restrict the ability of the ball to cross the goal plane). Thus, by pressing (or otherwise activating) the activation button corresponding to the goal air vents, the computing components 208 (i) receive the signal indicating activation of the activation button, (ii) determine the activated activation button corresponds to the goal air vents of the first player's goal, (iii) determine whether the first player has access to such an obstacle (e.g., the first player may have used his/her allotted instances of activating the goal air vents, or has not been given access to any instances by the computing components 208), and (iv) when the first player has access, transmit a signal to the goal air vents 300 within the first player's goal causing the activation of the goal air vents. The computing components 208 may then decrement a counter indicating the allocated number of instances of activating the goal air vents (e.g., an allocated modification).

Additionally, and in a similar manner, the computing components 208 may control the time duration for which the goal air vents 300 are activated. For example, the computing components 208 may initiate a timer simultaneously to the transmission of a signal to the goal air vents 300 with the timer representing a time duration for activation of the goal air vents 300. Upon expiration of the timer, the computing components 208 transmit a second signal to the goal air vents 300 causing deactivation thereof. In some embodiments, the timer may be predetermined (e.g., stored by the computing components 208) such that any activation of the goal air vents 300 is for the time duration of the predetermined time. In other embodiments, the duration of the timer may be tied to user input, e.g., a first activation button of the activation buttons 202-204 may correspond to selection of the goal air vents 300 while a second activation button of the activation buttons 202-204 may correspond to a selected time duration. In such embodiments, the initiated timer corresponds to the selected time duration.

Figure 3B:
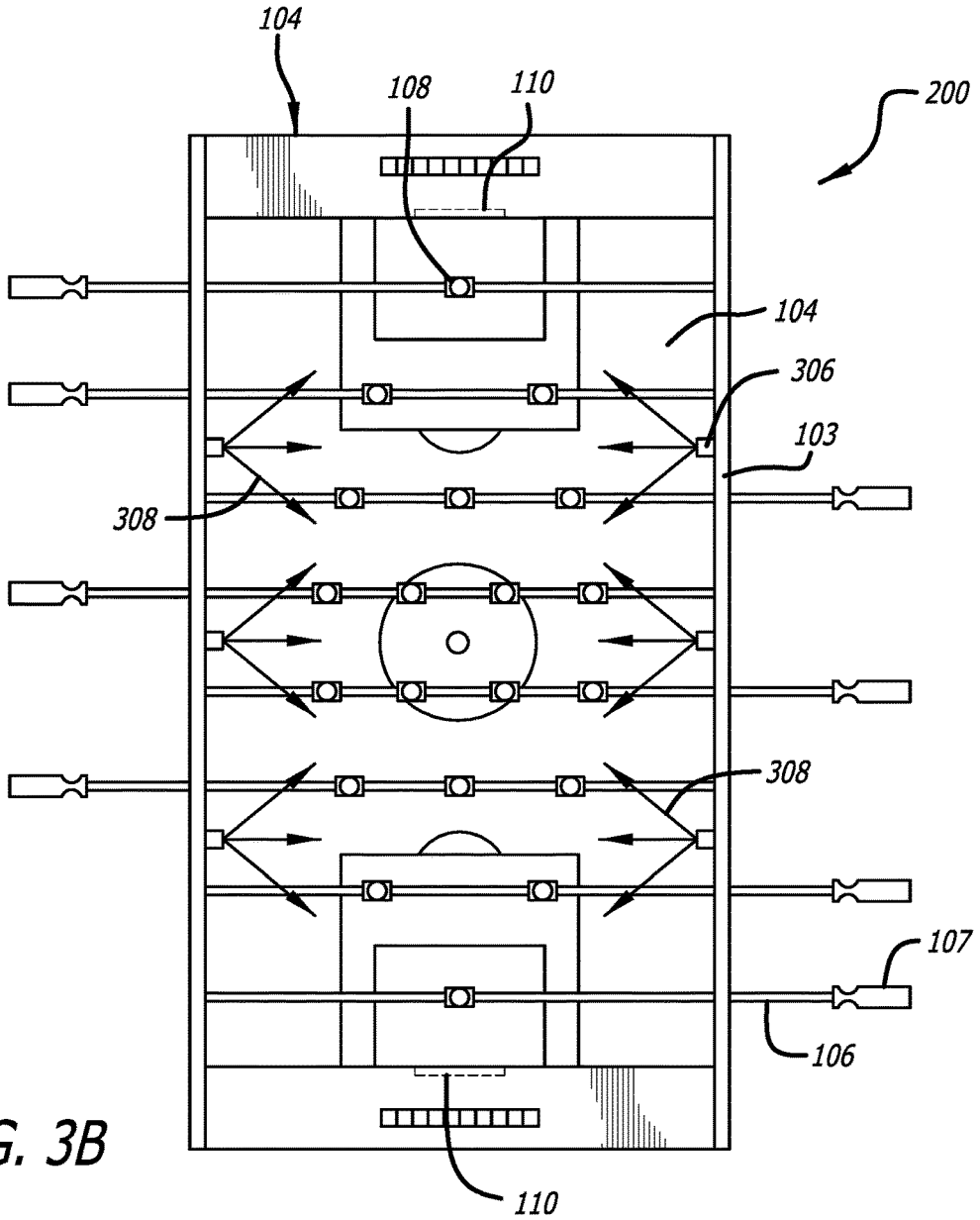
FIG. 3B illustrates a top-down view of the foosball table system of FIG. 2 implementing a plurality of sideline air vents in accordance with some embodiments.

Referring to FIG. 3B, a top-down view of the foosball table system of FIG. 2 implementing a plurality of sideline air vents is shown in accordance with some embodiments. The embodiment of FIG. 3B includes the sideline air vents 306 disposed along one or more sidelines, where a sideline corresponds to the interior of a sidewall 103. The sideline air vents 306 operate in the same manner as the goal air vents 300. In particular, the activation/deactivation of the sideline air vents 306 may be controlled by the computing components 208. The activation may be initiated by activation of an activation button 202-204. In some embodiments, sideline air vents 306 on one sideline may be activated at a time, while in other embodiments sideline air vents 306 on both sidelines may be activated simultaneously or concurrently (at least partially overlapping in time). In some embodiments, only a portion of the sideline air vents 306 may be activated (e.g., those disposed on a particular half), while in other embodiments, all sideline vents 306 may activated simultaneously or concurrently.

Figure 4A:
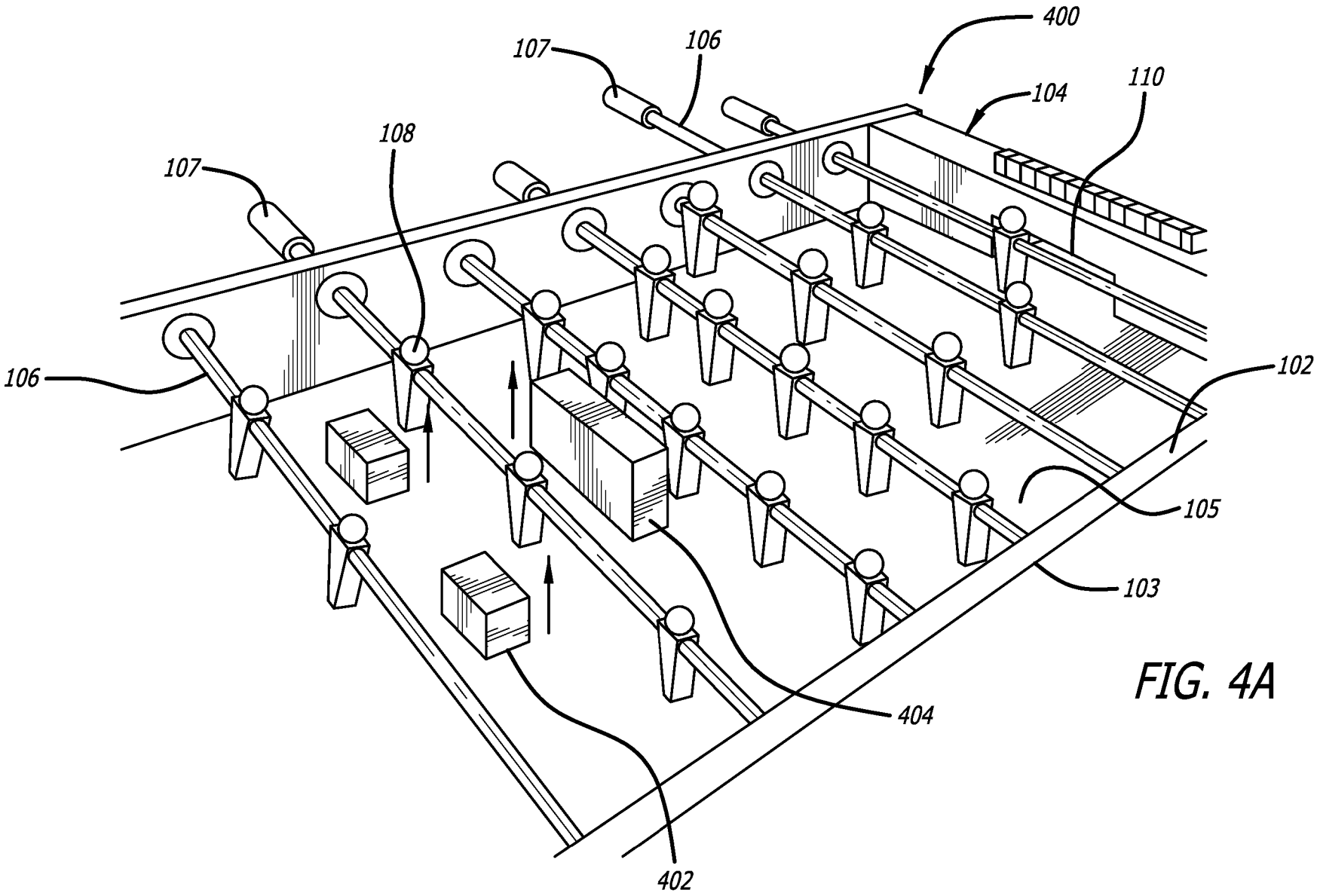
FIG. 4A illustrates a perspective view of a playing surface of a foosball table system implementing a plurality of playing field barriers in accordance with some embodiments.

Referring now to FIG. 4A, a perspective view of a playing surface of a foosball table system implementing a plurality of playing field barriers is shown in accordance with some embodiments. The foosball table system 400 may be similar to the foosball table 200 of FIG. 2A and include one or more barriers as discussed. For example, the playing surface 105 of the foosball table 400 is shown to include a plurality of barriers 402-404, including the set of barriers 402 having a first size and the barrier 404 having a second, larger size; however, the sizing may be different than that illustrated and still within the scope of the disclosure.

As annotated, the barriers 402-404 may be configured to "pop-up" (or rise) from the playing surface 105 (and conversely, lower). For example, each of the barriers 402-404 may be configured to alternate between a lowered (first) position and a raised (second) position. In some embodiments, when a barrier 402-404 is in the first position, the top of the barrier 402-404 may be on the same plane as the playing surface 105, e.g., forming a portion of the surface 105. When the barrier 402-404 is in the second position as illustrated in FIG. 4A, the barrier 402-404 acts as a blockade to the path of a foosball 212-213. In some embodiments, the barrier 402-404 may also act to restrict rotation of one or more rods 106 depending on the positioning and height of the barrier 402-404.

For example, as illustrated in FIG. 4A, a may have a height that is equal to (or substantially equal to) the top of the rods 106 (e.g., the barrier 404). In other embodiments, the height of the barrier may be less than the height of the rods 106 (e.g., the barriers 402). In some embodiments, the barrier 402-404 may have a height that the rods 106 are able to freely rotate without the rod 106 or the corresponding player components 108 contacting the barrier 402-404. In some embodiments, the barriers 402-404 may pop-up independently of each other, one or more of the barriers 402-404 may "pop-up" simultaneously or concurrently. Thus, the barriers 402-404 all need not be in the raised position at the same time.

As with the other alterations or obstacles discussed above, the activation/deactivation (e.g., raising/lowering) of the barriers 402-404 may be controlled by the computing components 208. In particular, the computing components 208 may receive a signal indicating user input to a particular activation button 202-204, determine that the activated activation button 202-204 corresponds one or more of the barriers 402-404 and transmit a signal activating (e.g., raising) one or more of the barriers 402-404 (e.g., activating an actuation motor configured to raise/lower the barrier 402-404). For example, a first player may be playing against a second player, and the first player may seek to activate one or more barriers 402-404 in order to hinder the ability of the second player to score (e.g., restrict the ability of the ball to travel in a particular direction). Thus, by pressing (or otherwise activating) the activation button corresponding to the one or more barriers 402-404, the computing components 208 (i) receive the signal indicating activation of the activation button, (ii) determine the activated activation button corresponds to the one or more barriers 402-404 (where the activated activation button may correspond to all or a subset of the barriers 402-404), (iii) determine whether the first player has access to such an obstacle (e.g., the first player may have used his/her allotted instances of activating the barriers 402-404 (or the subset corresponding to the activated actuation button), or has not been given access to any instances by the computing components 208), and (iv) when the first player has access, transmit a signal to the one or more barriers 402-404 causing the activation thereof. The computing components 208 may then decrement a counter indicating the allocated number of instances of activating the one or more barriers 402-404.

Additionally, and in a similar manner, the computing components 208 may control the time duration for which the one or more barriers 402-404 are activated (raised). For example, the computing components 208 may initiate a timer simultaneously to the transmission of a signal to the one or more barriers 402-404 with the timer representing a time duration for activation thereof upon expiration of the timer, the computing components 208 transmit a second signal to the one or more barriers 402-404 causing deactivation thereof. As discussed above, the timer may be predetermined (e.g., stored by the computing components 208) or may correspond to a time duration selected via user input.

Figure 4B:
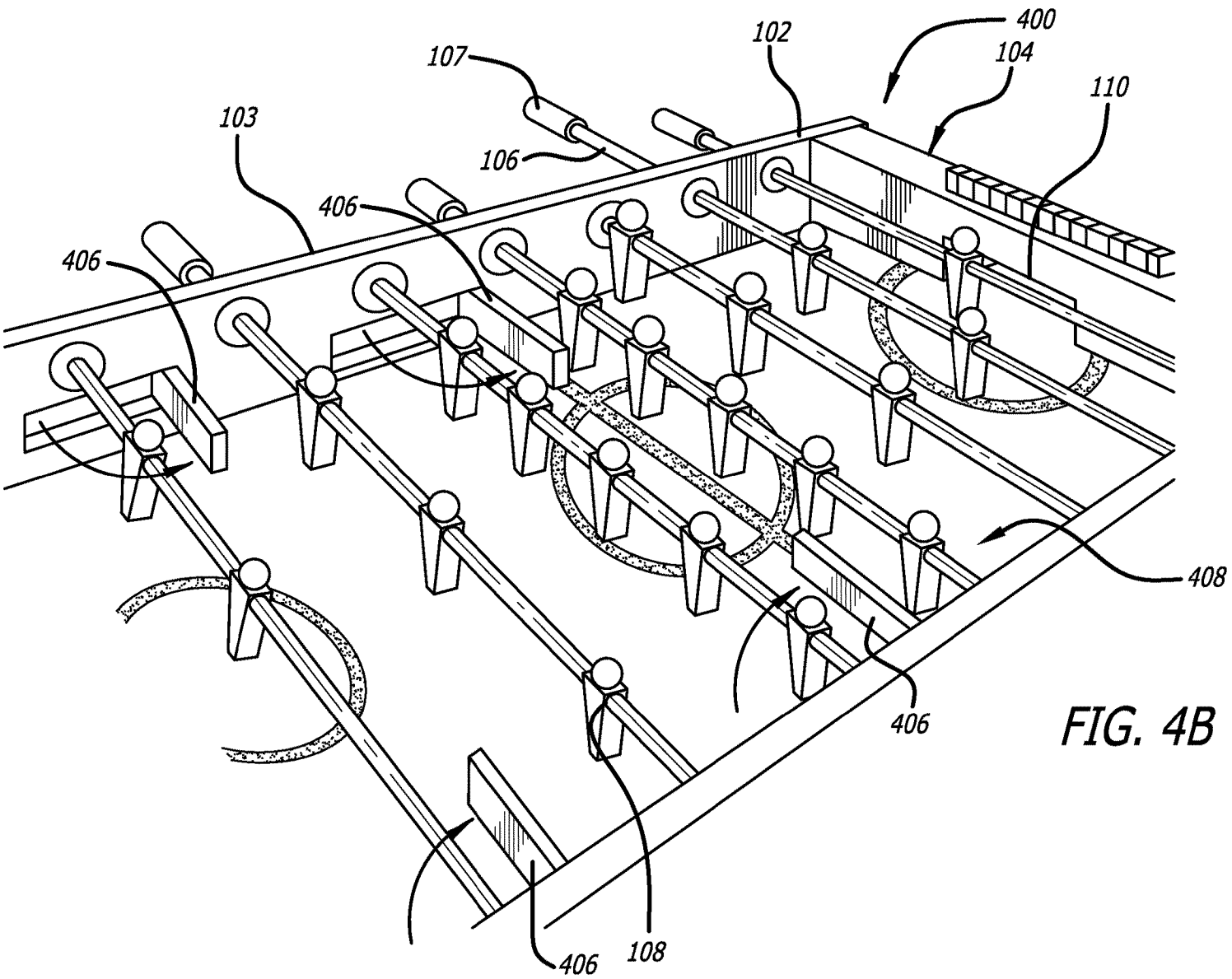
FIG. 4B illustrates a perspective view of a playing surface of the foosball table system of FIG. 4A implementing a plurality of sideline barriers in accordance with some embodiments.

Referring to FIG. 4B, a perspective view of a playing surface of the foosball table system of FIG. 2 implementing a plurality of sideline barriers is shown in accordance with some embodiments. The embodiment of FIG. 4B includes the sideline barriers 406 disposed along one or more sidelines, e.g., the interior of a sidewall 103. The sideline barriers 406 operate in the same manner as the barriers 402-404. The sideline barriers 406 may be activated via an actuation motor causing a sideline barrier 406 to swing out away from the interior of the sidewall 103. The activation may cause the sideline barrier 406 to open to a position such that the sideline barrier 406 is perpendicular to the sidewall 103 (as illustrated in FIG. 4B). However, in other embodiments, other such angles may be utilized (e.g., a barrier 406 may swing open 450 from the sidewall 103).

The activation/deactivation of the sideline barriers 406 may be controlled by the computing components 208. The activation may be initiated by activation of an activation button 202-204. In some embodiments, sideline barriers 406 on one sideline may be activated at a time, while in other embodiments sideline barriers 406 on both sidelines may be activated simultaneously or concurrently. In some embodiments, only a portion of the sideline barriers 406 may be activated (e.g., those disposed on a particular half), while in other embodiments, all sideline barriers 406 may activated simultaneously or concurrently. Deactivation may be controlled by the computing components 208 as noted above.

In some embodiments, the sideline barriers 406 may contact one of more of the player components 108 upon activation/deactivation, e.g., causing the contacted player component(s) 108 and corresponding rod 106 to rotate. In other embodiments, the length of the sideline barriers 406 may be such that no contact with the player components 108 will occur. For example, the rods 106 may include stoppers (not shown) that restrict forward/backward movement of the rods 106. Thus, the rods 106 may be restricted from moving forward/backward to a position in which a player component 108 would come into contact with a sideline barrier 406.

Additionally, in some embodiments, a foosball table system of the disclosure, e.g., the foosball table system 400, may include a playing surface comprised of a field display screen 408, which may include, for example, a light-emitting diode (LED) or a liquid-crystal display (LCD) screen. In some embodiments, the field display screen 408 may include a clear, protective covering such as a clear plastic casing, chemically strengthened glass (optionally including a laminate) or tempered glass. The field display screen 408 may provide various graphics that increase the excitement of the gameplay and retain interest as compared to a traditional playing surface. Examples of such graphics include, but are not limited or restricted to, a field (e.g., including changing weather conditions, team or corporate logos, etc.), a scoreboard, a timer, a listing of available obstacles/alterations, indications of goals scored, indications of expirations of timers (e.g., halftime or fulltime), celebratory videos (e.g., highlight videos of players from professional teams or animated videos, etc.).

In some embodiments, the image(s) or graphics rendered on the field display screen 408 of the foosball table system 400 may also act to enhance gameplay through electronic manifestations. For example, activation of an activation button 202-204 may result in the alteration of the image(s) or graphics rendered on the screen and may also visually indicate certain alterations to gameplay such as switching the goals for the two teams or players. For instance, with reference to FIG. 2A, "team A" may begin the game by attempting to score on the right-hand goal (i.e., the goal closest to the display $\mathbf{206}_2$). However, upon activation of one of the activation buttons $\mathbf{202}_1$, the goals may be switched such that "team A" will score by scoring in the opposite goal (i.e., the goal closest to the display $\mathbf{206}_1$). For instance, and referring again to FIG. 4B, the field display screen 408 may display a double arrow graphic and the text "SWITCH" or some other graphical indication.

Therefore, in some embodiments, in addition to causing alteration of the image(s) or graphics of the field display screen 408, activation of an activation button 202-204 also causes the computing components 208 to record the change such that when the sensors (such as the sensors $\mathbf{304}_1$-$\mathbf{304}_4$, or any limited combination thereof) detects a goal, the computing components 208 accurately record and, optionally, provide a display of the score.

An additional example of an alteration of the image(s) or graphics of the field display screen 408 may include an indication of a particular time period during which a scored goal is worth multiple goals (e.g., 2, 2.5, 3, 4, etc.). For instance, the image(s) or graphics may provide text indicating how many goals a single scored goal would be worth and a countdown timer indicating for how long such a modification of the gameplay will last. As referenced above, logic of the computing components 208 records such an alteration along any corresponding time period and determines how much a goal is worth (and to whom the point(s) are to be awarded) upon detection that a goal was scored.

Yet another example of an alteration of the image(s) or graphics of the field display screen 408 may include an indication that a team may "steal" a point from the opposing team (e.g., by being the first team to activate an activation button 202-204). Such an alteration may be triggered randomly throughout gameplay (e.g., logic of the computing components 208 may trigger such an image at a time during gameplay corresponding to a randomly generated number) or may be triggered at a particular point at an interval of games played (e.g., such is triggered every $10^{th}$ game played on the foosball table system 400 five minutes into gameplay). As referenced above, logic of the computing components 208 records such an alteration along any corresponding time period and determines how much a goal is worth (and to whom the point(s) are to be awarded) upon detection that a goal was scored.

Figure 5A:
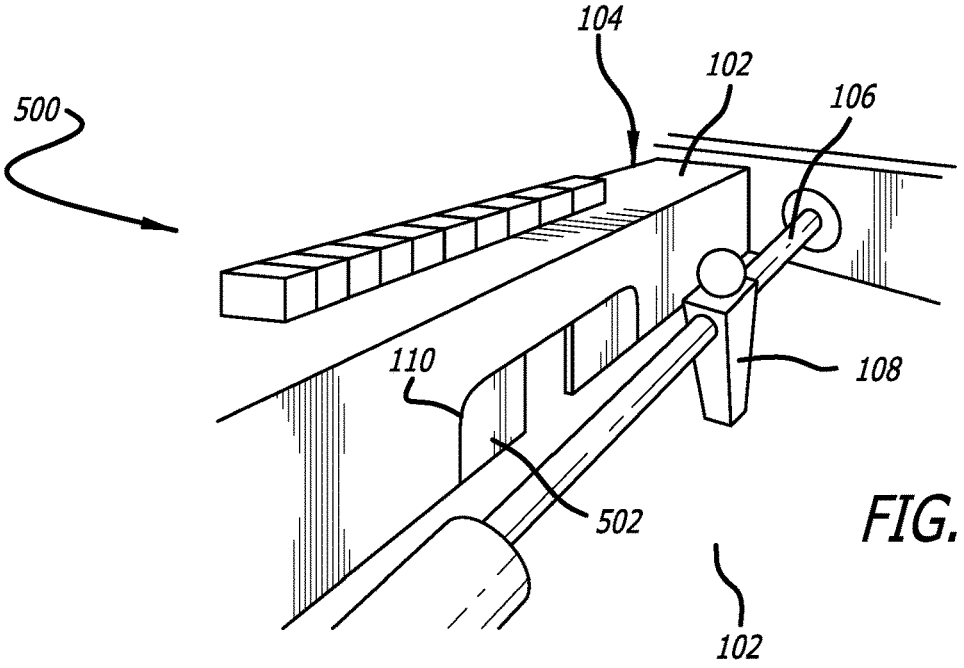
FIGS. 5A-5B illustrate perspective views of a goal mouth of a foosball table system implementing a goal mouth barrier in accordance with some embodiments.
Figure 5B:
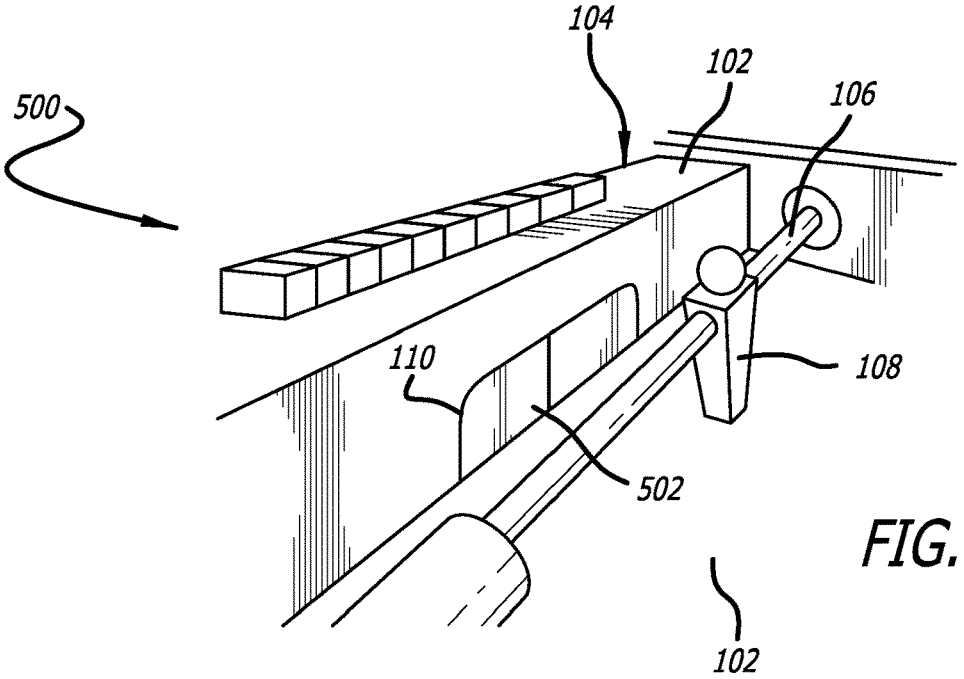

Referring to FIGS. 5A-5B, perspective views of a goal mouth of a foosball table system implementing a goal mouth barrier are shown in accordance with some embodiments. In some embodiments, the foosball table system 500 may be similar to the foosball table system 200 of FIG. 2 and include a goal mouth barrier 502 for each goal 110. The goal mouth barrier 502 may comprise one or more doors or blockades configured to open/close (e.g., via an actuation motor). In some embodiments, the goal mouth barrier 502 may be configured to fully close. However, in other embodiments, the goal mouth barrier 502 may be configured to only partially close. It should be understood that each goal mouth barrier 502 may operate independently of the other.

As with the other alterations or obstacles discussed above, the activation/deactivation (e.g., closing/opening) of a goal mouth barrier 502 may be controlled by the computing components 208. In particular, the computing components 208 may receive a signal indicating user input to a particular activation button 202-204, determine that the activated activation button 202-204 corresponds a goal mouth barrier 502 and transmit a signal activating (e.g., closing) a goal mouth barrier 502. For example, a first player may be playing against a second player, and the first player may seek to activate a goal mouth barrier 502 in order to hinder the ability of the second player to score (e.g., restrict the ability of the ball to enter into the goal 110 of the first player). Thus, by pressing (or otherwise activating) the activation button corresponding to the goal mouth barrier 502, the computing components 208 (i) receive the signal indicating activation of the activation button, (ii) determine the activated activation button corresponds to the goal mouth barrier 502, (iii) determine whether the first player has access to such an obstacle (e.g., the first player may have used his/her allotted instances of activating his/her goal mouth barrier 502, or has not been given access to any instances by the computing components 208), and (iv) when the first player has access, transmit a signal to the corresponding goal mouth barrier 502 causing the activation thereof. The computing components 208 may then decrement a counter indicating the allocated number of instances of activating the goal mouth barrier 502.

Additionally, and in a similar manner, the computing components 208 may control the time duration for which a goal mouth barrier 502 is activated (closed). For example, the computing components 208 may initiate a timer simultaneously to the transmission of a signal to a goal mouth barrier 502 with the timer representing a time duration for activation thereof. Upon expiration of the timer, the computing components 208 transmit a second signal to the goal mouth barrier 502 causing deactivation thereof. As discussed above, the timer may be predetermined (e.g., stored by the computing components 208) or may correspond to a time duration selected via user input.

Figure 6A:
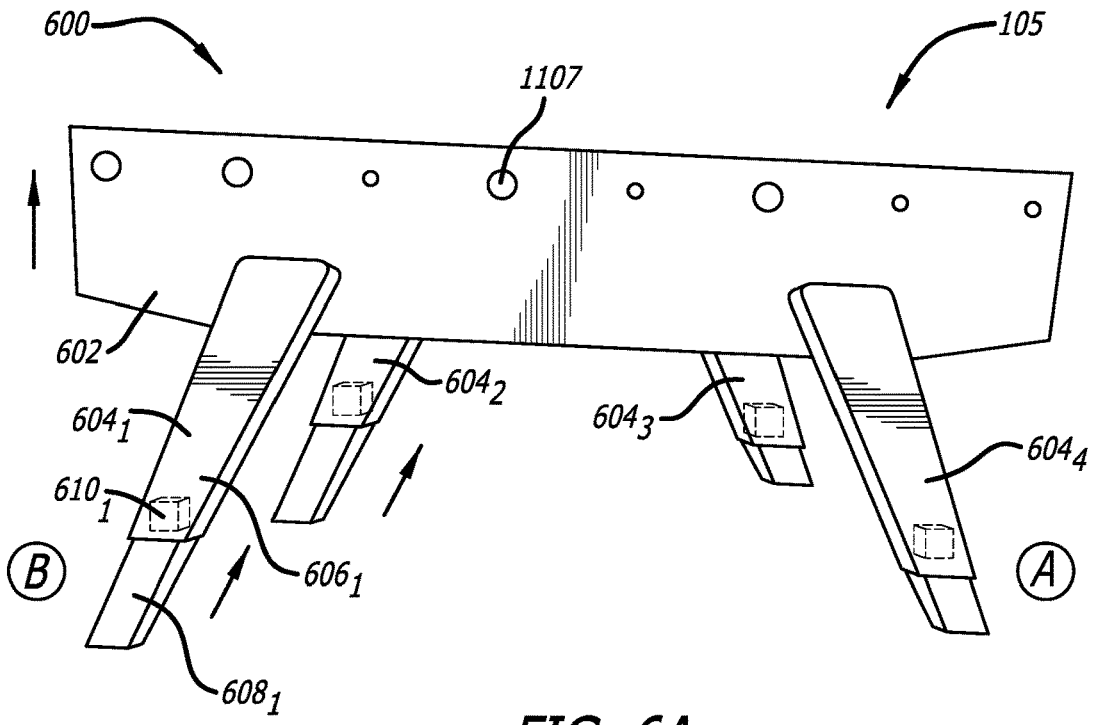
FIGS. 6A-6B illustrate perspective views of the foosball table system of FIG. 2 implementing actuators in the legs of the foosball table system of FIG. 2 in order to alter the angle of the playing field in accordance with some embodiments.
Figure 6B:
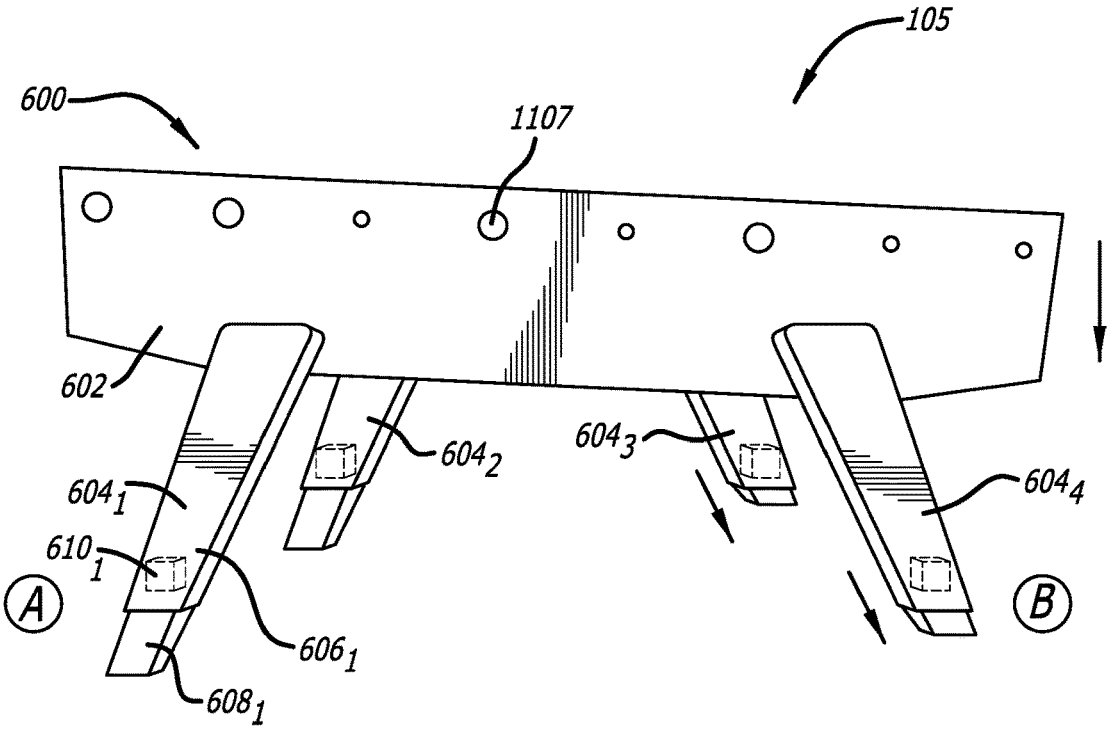

Referring to FIGS. 6A-6B, perspective views of a foosball table system implementing actuators in the legs of the foosball table system in order to alter the angle of the playing field are shown in accordance with some embodiments. In some embodiments, the foosball table system 600 may be similar to the foosball table system 200 of FIG. 2 and include a leg actuation system configured to cause the legs 604 to extend or retract thereby altering the plane of the playing surface 105.

A first embodiment of a leg actuation system is shown in FIG. 6A in which the legs may alternate between a first position (position A) and a second position (position B). In such an embodiment, position A may serve as the default position such that activation of the leg actuation system causes one or more legs $604_1$-$604_4$ to extend, thereby altering the plane of the playing surface 105. In particular, each of the legs $604_1$-$604_4$ is comprised of certain components, where the components for the leg $604_1$ will be discussed herein. Such components are equally included in the legs $604_2$-$604_4$.

The leg $604_1$ includes an outer leg $606_1$, an inner leg $608_1$ and an actuator $610_1$. The outer leg $606_1$ may include a hollow portion in which the inner leg $608_1$ may initially be disposed in the first position. Upon activation, the actuator $610_1$ may extend the inner leg $608_1$ away from the frame 602 thereby causing an alteration of the plane of the playing surface 105 (e.g., a tilt). For example, a single leg $604_1$-$604_4$ may be activated. For example, when only the leg $604_1$ is activated, the plane of the playing surface 105 is tilted toward the leg $604_3$. In other embodiments, multiple legs $604_1$-$604_4$ may be activated. For example, and as illustrated in FIG. 6A, when only the legs $604_1$-$604_2$ are activated, the plane of the playing surface 105 is tilted toward the legs $604_3$-$604_4$.

A second embodiment of a leg actuation system is shown in FIG. 6B in which the legs may alternate between a first position (position A) and a second position (position B). In such an embodiment, position A may serve as the default position such that activation of the leg actuation system causes one or more legs $604_1$-$604_4$ to retract or be condensed, thereby altering the plane of the playing surface 105. With respect to the embodiment of FIG. 6B, upon activation, the actuators $610_3$-$610_4$ may retract the inner legs $608_3$-$608_4$ toward the frame 602 thereby causing an alteration of the plane of the playing surface 105. Specifically, a tilt of the plane of the playing surface 105 toward the legs $604_3$-$604_4$ is implemented.

As with the other alterations or obstacles discussed above, the activation/deactivation (e.g., extending/retracting) of a leg $604_1$-$604_4$ may be controlled by the computing components 208. In particular, the computing components 208 may receive a signal indicating user input to a particular activation button 202-204, determine that the activated activation button 202-204 corresponds a leg $604_1$-$604_4$ and transmit a signal activating (e.g., closing) the corresponding leg $604_1$-$604_4$. For example, a first player may be playing against a second player, and the first player may seek to tilt the playing surface toward the second player's goal in order to hinder the ability of the second player to score (e.g., increase the difficultly of advancing the foosball toward the first player's goal due to gravity). Thus, by pressing (or otherwise activating) the activation button corresponding to one or more of the legs $604_1$-$604_4$, the computing components 208 (i) receive the signal indicating activation of the activation button, (ii) determine the activated activation button corresponds to one or more of the legs $604_1$-$604_4$, (iii) determine whether the first player has access to such an obstacle (e.g., the first player may have used his/her allotted instances of activating one or more of the legs $604_1$-$604_4$, or has not been given access to any instances by the computing components 208), and (iv) when the first player has access, transmit a signal to the corresponding one or more of the legs $604_1$-$604_4$ causing the activation thereof. The computing components 208 may then decrement a counter indicating the allocated number of instances of activating the one or more of the legs $604_1$-$604_4$.

Additionally, and in a similar manner, the computing components 208 may control the time duration for which one or more of the legs $604_1$-$604_4$ is activated (extended/retracted). For example, the computing components 208 may initiate a timer simultaneously to the transmission of a signal to one or more of the legs $604_1$-$604_4$ with the timer representing a time duration for activation thereof. Upon expiration of the timer, the computing components 208 transmit a second signal to the one or more of the legs $604_1$-$604_4$ causing deactivation thereof. As discussed above, the timer may be predetermined (e.g., stored by the computing components 208) or may correspond to a time duration selected via user input.

Figure 7:
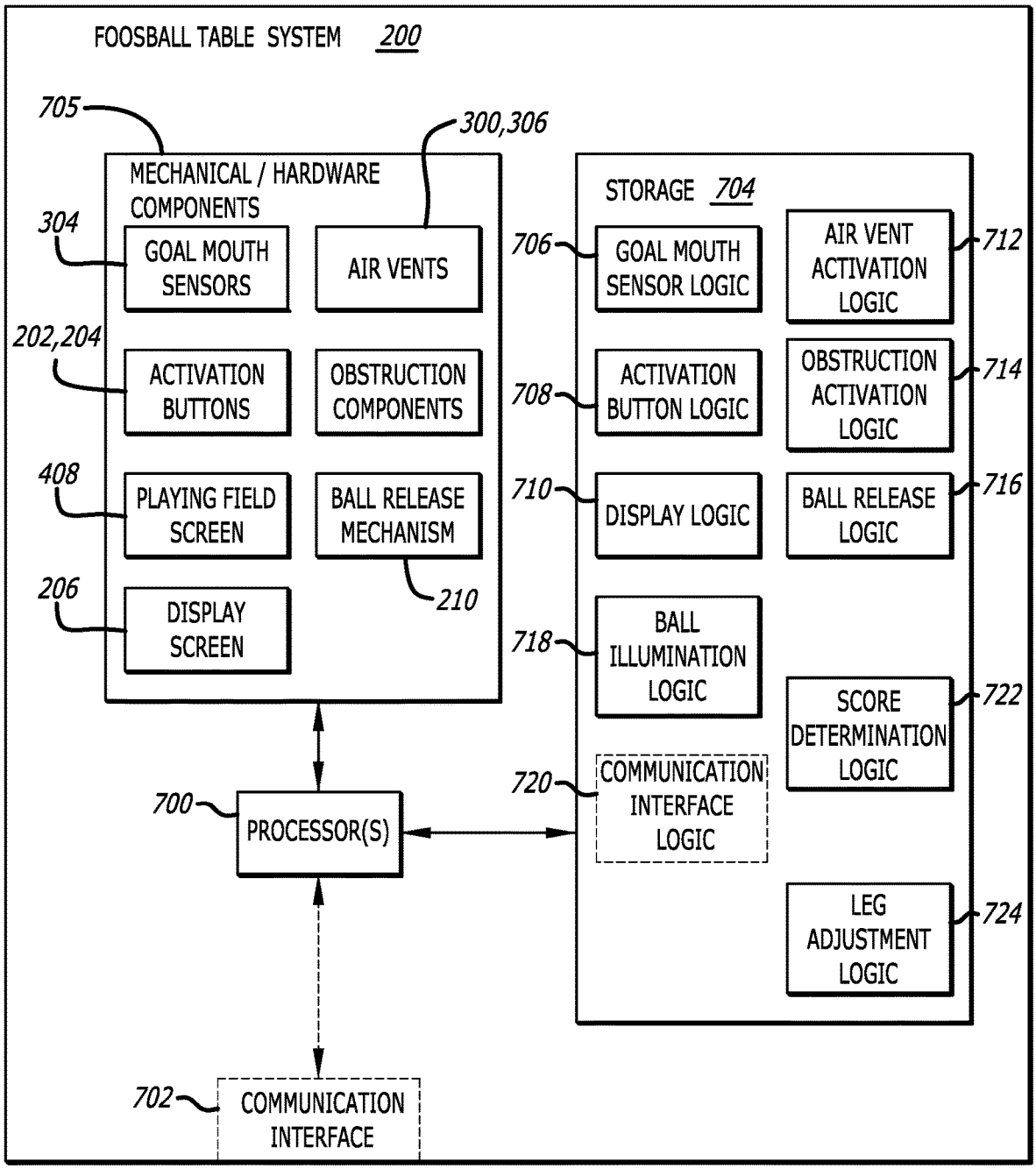
FIG. 7 is an exemplary embodiment of a logical representation the foosball table system of FIG. 2 in accordance with some embodiments.

Referring to FIG. 7, an exemplary embodiment of a logical representation the foosball table system of FIG. 2 is shown in accordance with some embodiments. The foosball table system 200 includes a frame, which may be made entirely or partially of a hardened material (e.g., hardened plastic, metal, glass, composite or any combination thereof) that forms a walled, rectangular playing surface having goals on opposing ends. The rectangular frame includes opposing sidewalls and opposing end walls, where a series of rods intersect each sidewall of the frame and extend across the playing surface. One or more player components (e.g., player figurines) are disposed on each rod, where the player components are situated to be able to contact a foosball advancing along the playing surface in order to redirect the foosball.

Further, the frame has coupled thereto a plurality of mechanical/hardware components 705 such as one or more obstacles, e.g., goal mouth sensors 304, activation buttons 204, one or more air vents 300 and 306 and/or obstruction component(s) (e.g., barriers 402-406 and/or goal mouth barriers 502). Further, the playing surface may be made out of the same material as the frame or may include a display screen, e.g., a light-emitting diode (LED) or a liquid-crystal display (LCD) screen). A ball storage and drop mechanism 210 is yet another aspect that may be included as part of (e.g., integrally formed) or coupled to the frame.

Additionally, the frame protects computing components 208 within the housing, namely one or more processors 700 that are coupled to the mechanical/hardware components 705, a non-transitory, computer-readable medium ("storage") 704, and an optional communication interface 702. The processor(s) 700 is coupled to the storage 704, which, according to one embodiment of the disclosure, has stored thereon logic modules including any of (a) a goal mouth sensor logic 706, (b) an activation button logic 708, (c) a display logic 710, (d) an air vent activation logic 712, (e) an obstruction activation logic 714, (f) a ball release logic 716, (g) a ball illumination logic 718, (h) the communication interface logic 720, (i) a score determination logic 722, and (j) a leg adjustment logic 724. Of course, when implemented as hardware, one or more of these logic units could be implemented separately from each other. It is noted that the computing components 208 discussed above may comprise each of the processors 700, the communication interface 702, the storage 704 including any logic stored on and the mechanical/hardware components 705.

Many of the logic modules within storage 704 account for determinations regarding the activation/deactivation of alterations or obstacles, e.g., the activation button logic 708, the air vent activation logic 712, the obstruction activation logic 714, the ball release logic 716, the ball illumination logic 718 and the leg adjustment logic 724. For instance, the activation button logic 708 is configured to receive signals from one or more activation buttons 202-204 and determine the obstacles or alteration to which the activation button 202-204 corresponds and provide an indication of activation to the corresponding logic module. The corresponding logic module then determines whether the corresponding player (or team) has access to activate the corresponding obstacle or alteration. Further, when the player (or team) has access to activate the particular obstacle or alteration, the corresponding logic module then causes a first signal to be transmitted to the corresponding mechanical/hardware component 705 to activate the obstacle or alteration. Further, the corresponding logic module may cause transmission of a second signal to cause deactivation of the obstacle or alteration.

As an illustrative example, when an activation button 202 is activated by a player on a first team, a signal is received by the processor 700 initiating execution of the activation button logic 708, which determines the activation button 202 corresponds to the sideline barriers 406. A datastore may be queried that stores activation button-obstacle/alteration pairings. As a result, the activation button logic 708 provides an indication to the obstruction activation logic 714 which, upon execution, is configured to determine whether to activate/deactivate any of the barriers 402-404, the sideline barriers 406 or the goal mouth barriers 502. The obstruction activation logic 714, upon execution, receives the indication from the activation button logic 708 and performs processing to determine whether the first team has access to activate the sideline barriers 406. In some embodiments, this processing may include querying a datastore that stores an allocation number for each obstacle for each team. Thus, by confirming that the allocation number for the sideline barriers 406 for the first team is at least '1', the obstacle activation logic 714 determines that the sideline barriers 406 are to be activated. As a result, the obstacle activation logic 714 causes transmission of a signal to one or more sideline barriers 406 (e.g., all, a subset assigned to the first team, or a subset selected by the first team, where the indication may be predetermined or provided via user input as discussed above). An actuation motor of each of the sideline barriers 406 to be activated is initiated and opens the sideline barriers. Further, the obstacle activation logic 714 may begin a timer and transmit a second signal to deactivate the sidelines barriers 406 at the expiration of the timer. The obstacle activation logic 714 may also decrement the stored allocation number for the sideline barriers 406 for the first team.

It should be understood that other logic modules stored on the storage 704 perform similar processes with respect to corresponding obstacles or alterations. Specifically, the air vent activation logic 712 corresponds to the goal air vents 300 and the sideline air vents 308, the ball release logic 716 and the ball illumination logic 718 correspond to the release and illumination of the money ball 212, and the leg adjustment logic 724 corresponds to the leg actuation system. Additionally, the score determination logic 722 may utilized with the ball release logic 716 and the ball illumination logic 718 in order to determine the number of goals to be given to a scoring team with respect to the scoring of a money ball 212.

The goal mouth sensor logic 706, upon execution, is configured to receive an indication that a goal was scored (e.g., a ball 212-213 broke a goal plane) and provide such to the score determination logic 722. The signal indicates which sensor(s) 304 transmitted the signal, thus indicating the goal 110 and which team is to be awarded, or potentially awarded, a number of goals.

The display logic 710 is configured to generate and/or cause the rendering of displays on either the displays 206 and/or the field display screen 408. The display logic 710 may receive an indication one or more trigger events, which cause the rendering of a display. For example, these triggering events may include, but are not limited or restricted to, a goal scored, activation/deactivation of an obstacle or alteration, the expiration of a timer (indicating halftime or fulltime). Displays indicating the cause of the triggering event may be rendered on the displays 206 and/or the field display screen 408, when present. Additionally, the display logic 710 may be configured to display the score of the game, the time remaining, any obstacles/alterations to which each team has access (e.g., just that the team has access, or the specific allotment of each obstacle/alteration). As discussed above, the various graphics that may be displayed in the field display screen 408, when present, may be generated and/or rendered by the display logic 710.

The optional communication interface 702, which, in combination with a communication interface logic 720, enables communications external network devices, e.g., server device for storing data related to gameplay (e.g., any of players, teams, time, score, weapons, etc.) or mobile devices of the players. According to one embodiment of the disclosure, the communication interface 201 may be implemented as a physical interface including one or more ports for wired connectors. Additionally, or in the alternative, the communication interface 702 may be implemented with one or more radio units for supporting wireless communications with other electronic devices. The communication interface logic 720, which is stored when the communication interface 702 is present, may include logic for performing operations of receiving and transmitting one or more objects via the communication interface 702 to enable communication between the foosball table system 200, a network device via a network (e.g., the internet or a LAN) and/or cloud computing services.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A foosball table system comprising:

a playing surface;

a plurality of walls extending upward relative to the playing surface including a first sidewall, a second sidewall opposite the first sidewall, a first end wall, and a second wall opposite the first end wall, wherein a plurality of rods extend through the first sidewall through the second sidewall;

a first goal on a first end wall;

a second goal on a second end wall;

a first set of user input controls;

a second set of user input controls;

one or more lights;

circuitry coupled to the one or more lights and configured to cause the one or more lights to emit a first color of light for a predetermined time period;

a processor; and a non-transitory, computer-readable medium communicatively coupled to the processor and having logic stored thereon that, when executed by the processor, causes performance of operations including:

receive user input from either of the first set of user input controls or the second set of user input controls, modify gameplay of a foosball game currently being played using the foosball table system, and detecting the foosball was scored in the second goal following expiration of the predetermined time period, incrementing a score of a second team or player by a plurality of goals resulting in an updated score, and displaying the updated score on a display screen of the foosball table system.

2. The foosball table system of claim 1, wherein modifying the gameplay includes automatically deploying a foosball onto the playing surface.

3. The foosball table system of claim 1, wherein the logic, when executed by the processor, causes performance of further operations including:

determining the foosball passed through either an opening of the first goal or an opening of the second goal within the predetermined time period, incrementing a score of either a first team or a second team by a plurality of goals, and displaying an overall score of the foosball game on a display screen of the foosball table system.

4. The foosball table system of claim 1, wherein the circuitry is further programmed to cause the one or more lights to emit a second color of light following expiration of the predetermined time period, and wherein the logic, when executed by the processor, causes performance of further operations including:

detecting the foosball was scored in the first goal prior to expiration of the predetermined time period, incrementing a score of a first team or player by a plurality of goals resulting in an updated score, and displaying the updated score on a display screen of the foosball table system.

5. The foosball table system of claim 1, wherein modifying the gameplay includes automatically adjusting a slope of the playing surface.

6. The foosball table system of claim 5, wherein automatically adjusting the slope of the playing surface includes transmitting a signal to an actuator within at least a first leg of the foosball table system, wherein the signal causes actuation of the actuator.

7. The foosball table system of claim 6, wherein actuation of the actuator includes one of extending or retracting a portion of the first leg.

8. The foosball table system of claim 1, wherein modifying the gameplay includes automatically activating a barrier of the foosball table system.

9. The foosball table system of claim 8, wherein automatically activating the barrier of the foosball table system includes transmitting a signal to an actuation motor thereby causing actuation of the actuation motor to deploy a goal mouth barrier in front of at least part of the first goal or the second goal.

10. The foosball table system of claim 8, wherein automatically activating the barrier of the foosball table system includes transmitting a signal to an actuation motor thereby causing actuation of the actuation motor to raise a playing surface barrier on the playing surface.

11. The foosball table system of claim 8, wherein automatically activating the barrier of the foosball table system includes transmitting a signal to an actuation motor thereby causing actuation of the actuation motor to deploy a sideline barrier from at least one of the first sidewall or the second sidewall.

12. The foosball table system of claim 1, wherein modifying the gameplay includes automatically activating one or more air vents.

13. The foosball table system of claim 12, wherein the one or more air vents are located within at least one of the first goal, the second goal, the first sidewall or the second sidewall.

14. The foosball table system of claim 12, wherein modifying the gameplay further includes automatically deactivating the one or more air vents after expiration of a predetermined time period.

15. The foosball table system of claim 1, wherein the playing surface is comprised of a display screen, and wherein modifying the gameplay includes altering an image rendered on the display screen.

16. The foosball table system of claim 15, wherein altering the image rendered on the display screen includes a reversal of a goal at which a first team or player is to score in order to be awarded one or more points.

17. The foosball table system of claim 1, wherein the logic, when executed by the processor, causes performance of further operations including:

determining whether the user input corresponds to an allocated modification.

18. The foosball table system of claim 1, further comprising:

one or more legs extending downward relative to the playing surface.

19. A foosball table system comprising:

a playing surface;

a plurality of walls extending upward relative to the playing surface including a first sidewall, a second sidewall opposite the first sidewall, a first end wall, and a second wall opposite the first end wall, wherein a plurality of rods extend through the first sidewall through the second sidewall;

a first goal on a first end wall;

a second goal on a second end wall;

a first set of user input controls;

a second set of user input controls;

a processor; and a non-transitory, computer-readable medium communicatively coupled to the processor and having logic stored thereon that, when executed by the processor, causes performance of operations including:

receive user input from either of the first set of user input controls or the second set of user input controls, modify gameplay of a foosball game currently being played using the foosball table system, wherein modifying the gameplay includes automatically activating a barrier of the foosball table system by transmitting a signal to an actuation motor thereby causing actuation of the actuation motor to deploy a sideline barrier from at least one of the first sidewall or the second sidewall.

20. The foosball table system of claim 19, wherein the logic, when executed by the processor, causes performance of further operations including:

determining the foosball passed through either an opening of the first goal or an opening of the second goal within the predetermined time period, incrementing a score of either a first team or a second team by a plurality of goals, and displaying an overall score of the foosball game on a display screen of the foosball table system.

21. The foosball table system of claim 19, the operations further include:

automatically activating a second barrier of the foosball table system by transmitting a second signal to a second actuation motor thereby causing actuation of the second actuation motor to deploy a goal mouth barrier in front of at least part of the first goal or the second goal.

22. The foosball table system of claim 19, the operations further include:

automatically activating a third barrier of the foosball table system by transmitting a third signal to a third actuation motor thereby causing actuation of the third actuation motor to raise a playing surface barrier on the playing surface.

* * * * *